United States Patent [19]

Sandmann

[11] 4,421,157

[45] Dec. 20, 1983

[54] STATOR SECTOR PLATE FOR REGENERATIVE AIR PREHEATER

[75] Inventor: Herbert Sandmann, Olpe, Fed. Rep. of Germany

[73] Assignee: Apparatebau Rothemühle Brandt & Kritzler GmbH, Wenden, Fed. Rep. of Germany

[21] Appl. No.: 408,729

[22] Filed: Aug. 17, 1982

[51] Int. Cl.[3] ..... F28D 17/00

[52] U.S. Cl. ..... 165/4; 165/7; 165/9

[58] Field of Search ..... 165/4, 7, 9, 10

[56] References Cited

U.S. PATENT DOCUMENTS

| | | | |
|---|---|---|---|
| 3,180,402 | 4/1965 | Moffat | 165/9 |
| 3,280,895 | 10/1966 | Chen et al. | 165/9 |
| 4,000,774 | 1/1977 | Puritz et al. | 165/9 X |

FOREIGN PATENT DOCUMENTS

| | | |
|---|---|---|
| 1237150 | of 0000 | Fed. Rep. of Germany . |
| 2162248 | of 0000 | Fed. Rep. of Germany . |
| 2400560 | of 0000 | Fed. Rep. of Germany . |

*Primary Examiner*—Albert W. Davis, Jr.
*Attorney, Agent, or Firm*—Karl F. Ross; Herbert Dubno

[57] ABSTRACT

A sector plate for a regenerative air preheater has an outer support ring centered on an axis and normally of cylindrical shape, an inner support ring centered on the axis, and a plurality of radially extending walls lying generally in axial planes and having outer ends fixed to the outer ring and inner ends and guided on the inner ring. A plurality of angularly extending and radially spaced annular walls extend between the radial walls and form therewith axially throughgoing passages. Thus when hot gases flow in one axial direction through the passages they thermally deform the radial walls so that their ends move into a position at an angle to each other. The ring is thermally deformed to a taper equal to twice the angle for holding the inner ends of the radial walls and the inner ring in the axially level with the outer ring when hot gases flow through the passages. The radial walls are normally—that is when of uniform temperature all over—planar and also rectangular, and the outer ring is similarly normally cylindrical. When the radial walls deform to become arcuate with their ends lying at a predetermined angle to the axis rather than parallel thereto, the outer ring is deformed to be frustoconical, flaring upstream relative to the gas-flow direction, so that the inner ends of the radial walls, while not parallel to the axis, are in the same axial position relative to the outer ring.

12 Claims, 6 Drawing Figures

STATOR SECTOR PLATE FOR REGENERATIVE AIR PREHEATER

FIELD OF THE INVENTION

The present invention relates to a sector plate for a regenerative air preheater. More particularly this invention concerns such a plate used to carry the thermal mass in such an arrangement.

BACKGROUND OF THE INVENTION

A so-called stator-type sector plate is formed as a large wheel centered on an upright axis and with a multiplicity of axially throughgoing passages that are angularly and radially separate and that are packed with heat-storing plates or the like constituting the thermal mass of the system. Upper and lower hoods are fitted over the upper and lower axially directed faces of this plate to subdivide the air flows through the plate so that the different streams can pass through the various passages, even in different directions.

In my earlier German patent application No. 2,162,248 published June 20, 1973 a system is disclosed where the hoods are of butterfly shape in axial projection, each being formed by two diametrically opposite 90° segments. These hoods are rotated together so that hot exhaust gases can flow through half of the segments in one direction while cooler combustion gases are flowed in the opposite direction. Periodically the hoods are stepped angularly to change the alignment and allow the heated thermal mass or matrix to give off its heat to the combustion gases. As a rule the hoods are journaled on a post fixed in the center of the stator, and carry seals closely juxtaposed with the respective faces thereof.

Such arrangements are quite large, often having a diameter of more than 8 m. The extremes in temperature between the two faces of the plate can therefore account for axial movements of more than 50 mm, cupping the entire sector plate so that its entry side is convex and its exit side is concave. This has the effect of raising the core or center of the plate in the standard situation where the hot air flows down through the sector plate. As a result the upper hood, which is carried like the lower hood on a post fixed in the center of the sector plate, is lifted relative to the upper face and can leave quite a gap at the outer edge of the plate while the outer edges of the plate move toward the lower hood. The standard sliding seal urged by springs against the surface it is sealing cannot normally compensate for such displacements. Thus seal arrangements must be provided that can resist the enormous heat encountered while not inhibiting motion between the plate and the structure facing it.

Various complex systems have been suggested to reduce this leakage. Forming the support frame for the thermal mass of a plurality of concentric spaced rings, as described in German Pat. No. 1,237,150 filed Oct. 3, 1964 by H. Brandt, has been found to reduce the deformation somewhat. The deformation is corrected right at the seals in the system of German patent document No. 2,205,838 filed Feb. 8, 1972 by E. Puritz, wherein thermal bilayer bars that bend greatly when heated act through lever mechanisms on the seals to cancel out the effect of the sector-plate deformation on them. A thermally actuated seal arrangement for a sector plate is seen in U.S. Pat. No. 3,246,687 of A. Jensen et al.

Other systems employ complex metallic bellows-type seals and just let the sector plate deform. Such means can compensate to a limited extent, but do not eliminate the deleterious effects of the thermal deformation of the sector plate. Similarly suspending the seals from supports on the bearing housing has proven an equally problem-filled method of accommodating to the thermal-deformation problem.

None of these arrangements operates easily. They all require complex mechanical arrangements or actions in a structure that is subject to enormous temperature variations. Making any mechanism work in such circumstances is difficult, as its pieces are as subject to thermal deformation as the sector plate they are to act on.

OBJECTS OF THE INVENTION

It is therefore an object of the present invention to provide an improved stator-type sector plate.

Another object is the provision of such a stator-type sector plate which overcomes the above-given disadvantages.

A yet further object is to provide a novel sector-plate frame which can accommodiate to thermal deformation without the use of any mechanism at the sector plate.

SUMMARY OF THE INVENTION

These objects are attained according to the instant invention in a sector plate for a regenerative air preheater which has an outer support ring centered on an axis and normally of cylindrical shape, an inner support ring centered on the axis, and a plurality of radially extending walls lying generally in axial planes and having outer ends fixed to the outer ring and inner ends and guided on the inner ring. A plurality of angularly extending and radially spaced annular walls extend between the radial walls and form therewith axially throughgoing passages. Thus when hot gases flow in one axial direction through the passages they thermally deform the radial walls so that their ends move into a position at an angle to each other. Means is provided for thermally deforming the outer ring to a taper equal to twice this angle for holding the inner ends of the radial walls and the inner ring axially level with the outer ring when hot gases flow through the passages.

Thus with the system of this invention stresses are completely eliminated from the sector plate. The radial walls, where the principal or most important thermal deformation takes place, are allowed to deform without becoming internally stressed. These radial walls are normally—that is when of uniform temperature all over—planar and also rectangular, and the outer ring is similarly normally cylindrical. When the radial walls deform to become arcuate with their ends lying at a predetermined angle to the axis rather than parallel thereto, the outer ring deforms to be frustoconical, flaring upstream relative to the gas-flow direction, so that the inner ends of the radial walls, while not parallel to the axis, are in the same axial position relative to the outer ring. As a result the inner ring is in the same axial position relative to the outer ring. A distribution hood for the gases whose heat is being recovered or for the gases picking up the recovered heat will therefore not move axially relative to the plate when it is heated.

Thus according to the instant invention the radial walls have, when of uniform temperature, a radial length equal to $(D-K)/2$ where D is the overall diameter of the stator plate and K is the diameter of the core ring.

In accordance with another feature of this invention the outer ring has an inner face having, relative to the direction of flow of the gases, an upstream portion and a downstream portion. The thermal-deformation means includes a layer of thermal insulation on the upstream portion. The downstream portion is uninsulated and exposed on its inner face.

According to another feature of this invention the outer ring has an upstream flange and a downstream flange. The latter is exposed and uninsulated inwardly at least. In addition according to this invention the insulation layer is of increasing thickness in the upstream direction.

The outer ring according to this invention has an outer surface wholly covered by an outer layer of thermal insulation which is formed with an annular chamber surrounding the upstream portion. The thermal-deformation means further comprises means for flowing a heat-exchange fluid at a temperature different from that of the gas through the chamber. This temperature-control means has at least one position sensor juxtaposed with the inner ring. It may also have at least one temperature sensor on the outer ring. It is possible according to this invention to subdivide this chamber angularly and/or axially into a plurality of subchambers each having its own sensors and controller for passing the necessary heat-exchange fluid, whether hot or cold relative to the respective subchamber, through it in response to local conditions.

To further allow for differences between rates of thermal expansion and contraction, the outer ring is provided with a flexible element forming the downstream end of the chamber. In addition the arrangement has guides between the inner ring and the inner ends of the radial walls. These guides include downstream guides radially slidable relative to the respective outer ends and upstream guides nonradially displaceable relative thereto.

According to another feature of this invention the sector plate has a radially innermost angularly extending wall spaced radially immediately outside the inner ring and sealed to the radial walls. This innermost wall prevents leakage at the loose fit between the inner ends of the radial walls and the inner ring.

DESCRIPTION OF THE DRAWING

The above and other features and advantages will become more readily apparent from the following, reference being made to the accompanying drawing in which.

SPECIFIC DESCRIPTION

Figure 1:
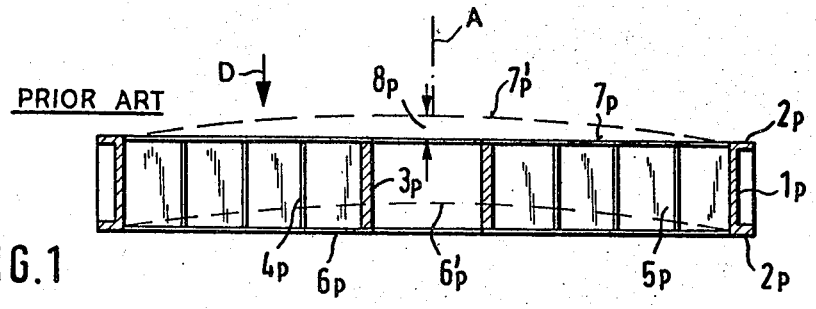
FIG. 1 is an axial section through a prior-art sector plate.

As seen in FIG. 1, a prior-art stator-type sector plate has an outer support ring or collar 1*p* centered on an axis A and having flanges 2*p* giving it a radially outwardly open U-section, and a core or inner support ring 3*p* between which extend radial walls 11*p*. Annular or angularly extending walls 4*p* subdivide the segmental spaces between adjacent walls 11*p* into spaces or passages 5*p* that are normally filled with some heat matrix, such as described in U.S. Pat. No. 3,288,204 of L. Grames et al. The sector plate has an axially downwardly directed lower face 6*p* and an opposite upper face 7*p*. When the device is in use, with hot gases flowing down through it in axial direction D, the temperature difference between its faces 6*p* and 7*p* can be 200° C. to 300° C. Hence the upper portions of the radial walls 11 will become longer than the lower portions and the plate will deform so its lower and upper faces 6*p* and 7*p* assume the positions shown at 6*p'* and 7*p'*, respectively, in FIG. 1. The maximum axial deformation 8*p* can exceed 50 mm in a plate of diameter greater than 8 m.

Figure 2:
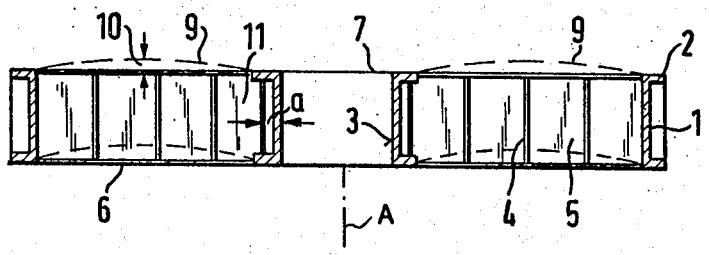
FIG. 2 is an axial section through a sector plate according to this invention.

FIG. 2 shows the system according to the instant invention, using the same reference numerals as FIG. 1 for functionally identical structure but without the postscript p's. This arrangement can be seen to have eliminated the cupping of the entire stator wheel, having instead confined it to the radial walls. The resultant axial deformation is shown at 10, and is much smaller than the deformation 8*p* of FIG. 1.

Figure 3:
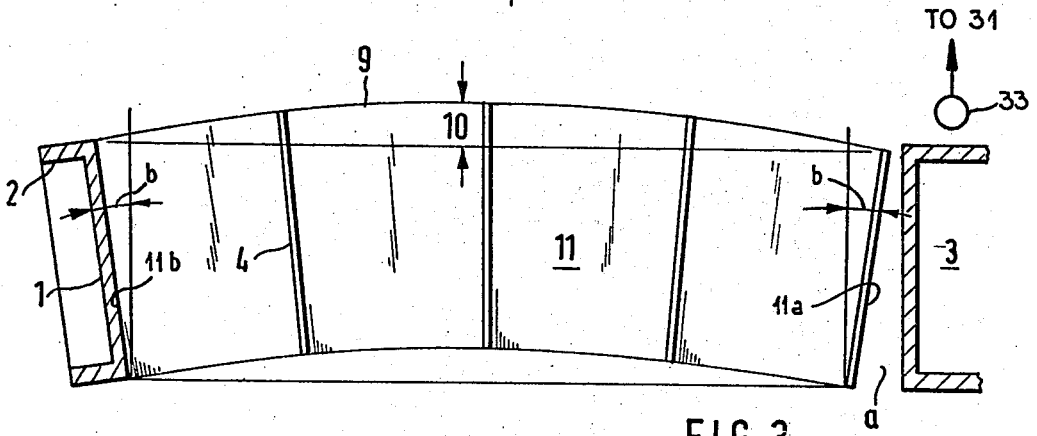
FIG. 3 is a large-scale view of a detail of the sector plate of this invention.

As seen in FIG. 3 the radial walls 11 have inner ends 11*a* spaced radially by a distance a from the inner ring or collar 3. In use the upper edge of each wall 11 will curve as shown at 9, deforming through the axial distance 10. Such deformation puts the end edges 11*a* and 11*b*, which are parallel to the axis A when the walls 11 are of uniform temperature, at angles b to the axis A. The ends 11*a* and 11*b* move through twice this angle b with respect to each other, since they move oppositely.

According to this invention the outer support ring 2 is deformed to have a conicity equal to b so that the core ring 3 does not move axially as the walls 11 deform. In this manner hoods journaled on the ring 3 or the post extending therethrough do not move and the clearance does not change at this location, since the planes 6 and 7 defined by the lower and upper faces of the rings 1 and 3 are maintained. The length change of the radial walls 11 is substantially unimpeded so that only the friction between the core ring 3 and the walls 11 need be overcome.

Figure 4:
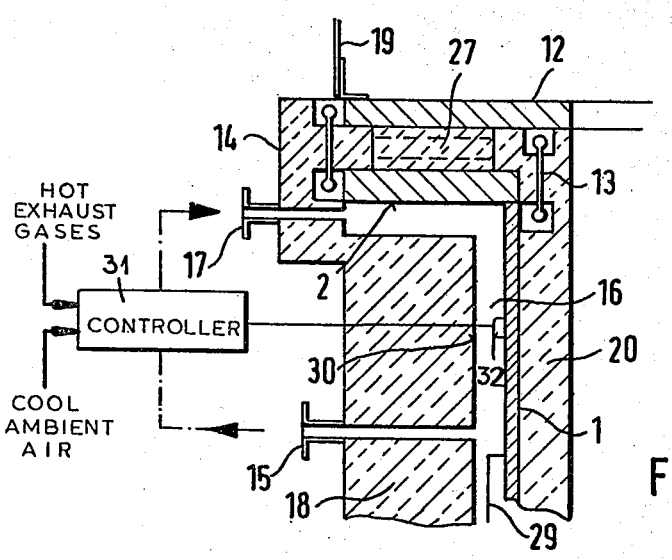
FIG. 4 is an other large-scale sectional detail view, partly in diagrammatic form, through the sector plate according to the invention.
Figure 5:
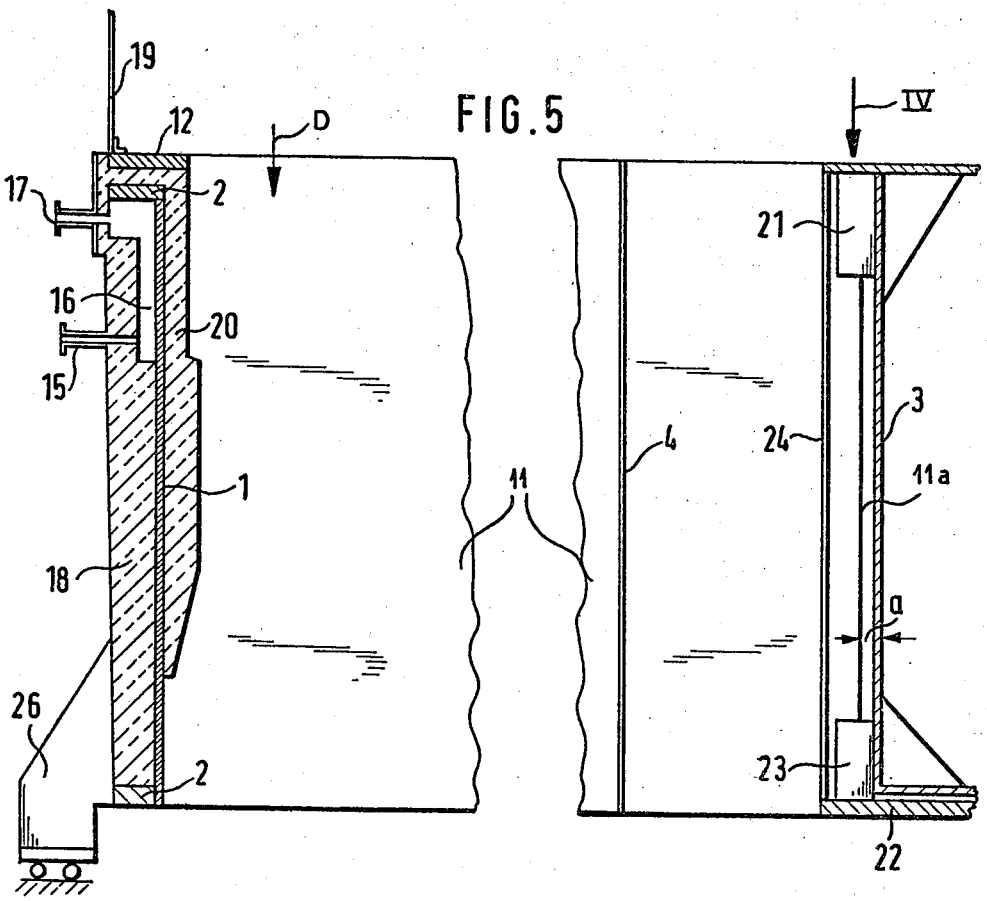
FIG. 5 is another axial section through the sector plate according to the invention.

This is achieved as shown in FIGS. 4 and 5 by providing on the upper portion or hot side of the outer support ring 1 on its inner face a layer 20 of thermal insulation. The lower or cold side of this ring 1 is not internally covered with insulation, so that it will be at the temperature of the gases flowing over it.

The outside of the ring 1 is covered with an annular jacket 18 of thermal insulation as is common to prevent heat waste. The upper flange 2 is also covered with insulation, and carries a connection flange 12 on which the exhaust-gas housing 19 is connected. This ring 12 is not insulated internally. At its lower edge the ring 1 is movably supported by feet 26 and the ring 3 has a lower support plate 22 on which the lower manifold or hood is positioned.

Thus according to this invention the ring 1 is given a conicity equal to b. Were the ring 1 to remain cylindrical or to have a smaller conicity, arcing of the walls 11 would depress the core ring 3 axially. Instead according to this invention the outer ring 1 is given a frustoconical shape of conicity b so that the inner edges 11*a* of the radial walls 11 do not move axially, only slightly radially. This radial movement is accommodated by the play a.

In order to actively cause the desired degree of thermal deformation, the upper or hot side of the outer insulating layer 18 is formed with an annular compartment 16 extending somewhat in the axial direction and allowing the upper region of the outer support ring 1 to be cooled when the conicity is too great. The lower surface of the upper flange 2 and the outer surface of the upstream portion of the ring 1 is exposed in the compartment 16 which has connections 17 by which ambient air from the entry side of the air preheater can be fed into the compartment 16 in order to cool the corresponding region of the ring 1 and axially offset outlets 15 from which this coolant fluid can leave the chamber, to be mixed with the entering exhaust gases so as not to waste heat.

If the conicity is too small, that is less than b, hot air can be fed through the compartment 16 in the same manner. The feed of hot or cool air is established by a controller 31 that has one or more temperature sensors on the ring 1 and one or more position sensors 33 at the inner ring 3. The compartment 16 can be divided into an annular succession of subcompartments each with a respective pair of connection pipes 15 and 17 and its own controller 31 with sensor 32.

In FIG. 4 links 13 are shown for connecting the mounting ring 12 to the flange 2 so that these two elements can move limitedly radially relative to each other. In addition slide rails 27 permitting this radial motion are spaced around the assembly so that the two parts remain perfectly concentric. The cylindrical outer wall of the chamber 16 is connected via a flexible floor element 29 to the ring 1 to permit relative radial movement of these parts also.

FIG. 5 shows guides 21 connecting the upper regions of the walls 11 to the core 3, normally with tangential screws securing the parts together. Lower guides 23 are fixed to the lower plate 11 but permit limited radial movement of the corresponding portions of the walls 11. Leakage between the inner edges 11*a* and the core 3 is prevented by an annular inner wall 24 that extends axially and is welded to the walls 11 slightly outward of their inner edges 11*a*.

Figure 6:
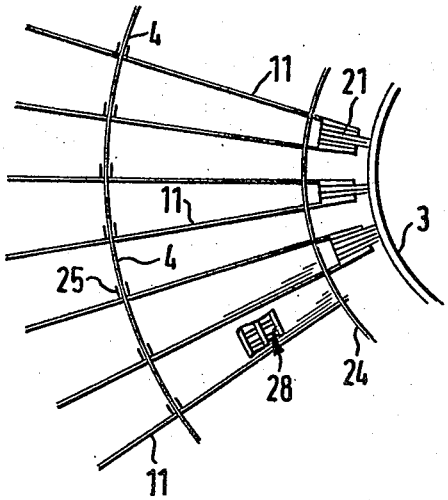
FIG. 6 is a view taken in the direction VI of FIG. 5.

The walls 4 are each formed of a succession of part-cylindrical plates having one edge soldered to one of the respective walls 11 and another edge received in a guide 25 on the other respective wall 11. The walls 4 and 11 define as shown in FIG. 6 axially extending passages or chambers 5 that can be filled with a heat matrix or thermal mass such as the pack of plates indicated in one passage 5 at 28.

EXAMPLE

A prior art plate having a diameter of 15 m and an axial dimension of 2 m is axially traversed by hot air so that its incoming face is at a temperature 260° C. higher than its outgoing face. The resultant thermal deformation accounts for a movement through 43 mm of the stator core.

A sector plate of the same dimensions and under the same operating conditions, but built according to this invention, can easily hold axial displacement to at most 6 mm, less than one-seventh what was considered normal in the prior art. Such short displacement can easily be compensated out by conventional spring-loaded seals.

I claim:

1. A sector plate for a regenerative air preheater, the plate comprising:

an outer support ring centered on an axis and normally of cylindrical shape;

an inner support ring centered on the axis;

a plurality of radially extending walls lying generally in axial planes and having outer ends fixed to the outer ring and inner ends and guided on the inner ring;

a plurality of angularly extending and radially spaced annular walls extending between the radial walls and forming therewith axially throughgoing passages, whereby when hot gases flow in one axial direction through the passages they thermally deform the radial walls so that their ends move into a position at an angle to each other; and means for thermally deforming the outer ring to a taper equal to twice the angle for holding the inner ends of the radial walls and the inner ring in the axially level with the outer ring when hot gases flow through the passages.

2. The air-preheater sector plate defined in claim 1 wherein the ends of the radial walls normally are parallel to each other.

3. The air-preheater sector plate defined in claim 1 wherein the outer ring has an inner face having, relative to the direction of flow of the gases, an upstream portion and a downstream portion, the means including a layer of thermal insulation on the upstream portion, the downstream portion being uninsulated and exposed.

4. The air-preheater sector plate defined in claim 3 wherein the outer ring has an upstream flange and a downstream flange, the latter being exposed and uninsulated inwardly at least.

5. The air-preheater sector plate defined in claim 3 wherein the insulation layer is of increasing thickness in the upstream direction.

6. The air-preheater sector plate defined in claim 3 wherein the outer ring has an outer surface wholly covered by an outer layer of thermal insulation which is formed with an annular chamber surrounding the upstream portion, the means further comprising means for flowing a heat-exchange fluid at a temperature different from that of the gases through the chamber.

7. The air-preheater sector plate defined in claim 6 wherein the means includes at least one position sensor juxtaposed with the inner ring.

8. The air-preheater sector plate defined in claim 6 wherein the means includes at least one temperature sensor on the outer ring.

9. The air-preheater sector plate defined in claim 6 wherein the outer ring is provided with a flexible element forming the downstream end of the chamber.

10. The air-preheater sector plate defined in claim 1, further comprising guides between the inner ring and the inner ends of the radial walls.

11. The air-preheater sector plate defined in claim 10 wherein the guides includes downstream guides radially slidable relative to the respective outer ends and upstream guides nonradially displaceable relative thereto.

12. The air-preheater sector plate defined in claim 1, further comprising:

a radially innermost angularly extending wall spaced radially immediately outside the inner ring and sealed to the radial walls.

* * * * *